United States Patent [19]

Cilione

[11] 4,309,806

[45] Jan. 12, 1982

[54] APPARATUS AND METHOD FOR APPLYING A SNAP FASTENER TO A SHEET MATERIAL

[75] Inventor: Augustine Cilione, North Providence, R.I.

[73] Assignee: U.S. Industries, Inc., New York, N.Y.

[21] Appl. No.: 115,244

[22] Filed: Jan. 21, 1980

[51] Int. Cl.[3] ..... B23P 11/00

[52] U.S. Cl. ..... 29/432.1; 29/243.52; 227/15; 24/216

[58] Field of Search ..... 29/432, 432.1, 243.52; 227/12, 15; 24/216, 217 R

[56] References Cited

U.S. PATENT DOCUMENTS

| | | | |
|---|---|---|---|
| 2,310,007 | 2/1943 | Walff | 29/432.1 |
| 2,327,164 | 8/1943 | Book | 24/216 |
| 2,345,476 | 3/1944 | Huelster et al. | 227/15 |
| 2,371,813 | 3/1945 | Fenton | 29/432.1 |
| 2,413,702 | 1/1947 | Fenton | 227/15 |
| 2,920,325 | 1/1960 | Janes et al. | 227/15 |
| 3,019,442 | 2/1962 | Hoeckele | 227/15 X |

FOREIGN PATENT DOCUMENTS

| | | | |
|---|---|---|---|
| 359687 | 10/1931 | United Kingdom | 227/15 |

*Primary Examiner*—Charlie T. Moon
*Attorney, Agent, or Firm*—Salter & Michaelson

[57] ABSTRACT

Apparatus and method for applying a snap fastener to a sheet of material, wherein the snap fastener includes a cap member having fastening means extending outwardly thereof and further includes a fastener member that is formed to receive the fastening means for interlocking said cap and fastener members on opposite sides of the sheet material, the apparatus including an annular flexible member that is movable into engaging relation with the sheet material as the fastening means of the cap member are penetrated therethrough, the annular flexible member circumscribing the area of sheet material through which the prongs are inserted and radially stretching the circumscribed area as said prongs are penetrated through the material so as to prevent wrinkling of the material after the application of the snap fastener thereto.

7 Claims, 3 Drawing Figures

APPARATUS AND METHOD FOR APPLYING A SNAP FASTENER TO A SHEET MATERIAL

BACKGROUND OF THE INVENTION

The present invention relates to the application of a snap fastener to a garment or to an imperforate sheet of material, wherein the snap fastener defines a closure member for the sheet material.

Snap fasteners as normally applied to garments or sheet material include a cap member having fastening means such as prongs extending outwardly thereof and a fastener member that is shaped to receive the prongs for interlocking the cap and fastener members on opposite sides of the sheet material. The fastener member can take the form of a socket, or a stud, depending upon the location of the fastener on the sheet material.

In the application of the snap fastener to the sheet material, it is necessary that the sheet material be maintained in a relatively taut or tensioned position as the cap member prongs are penetrated therethrough for engagement with the portion of the fastener member that is shaped to receive the prongs. Prior to the instant invention, and as best illustrated in the Wolff, U.S. Pat. No. 2,310,007, the application of a snap fastener to the sheet material was accomplished by locating clamping elements in clamping relation on the sheet material wherein an annular area was defined by the clamping elements. Thus, the clamping elements in this prior known apparatus attempted to positively grip the material surrounding the circumscribed area of the sheet material for preparing the circumscribed area to receive the prongs of the cap member therethrough during the application of the snap fastener thereto. One of the objects of the invention in U.S. Pat. No. 2,310,007 was to restrict stretching of the material within the circumscribed area as the prongs penetrated therethrough during the application of the cap member to the fastening member. Although the apparatus as disclosed in U.S. Pat. No. 2,310,007 attempted to retain the material as circumscribed by the clamping elements in firm position and attempted to effectively prevent the sheet material outside the circumscribed area from stretching, the material did tend to give as the prongs penetrated therethrough which resulted in some puckering or wrinkling around the cap member and fastener member following the securement thereof to the sheet material.

As will be described, the purpose of the subject invention is to avoid the wrinkling of the sheet material after the application of a snap fastener thereto and withdrawal of the means for retaining the sheet material in place during the applying operation.

SUMMARY OF THE INVENTION

An apparatus and a method for applying a snap fastener to an imperforate sheet of material, wherein the snap fastener includes a cap member having fastening means extending outwardly thereof and a fastener member that is shaped to receive the fastening means for interlocking said cap and fastener members on opposite sides of the sheet material, a first tool member being located on one side of the sheet material during the applying operation and being engageable with the cap member for moving the cap member in an axial direction to cause the fastening means to penetrate the sheet material, and a second tool member located on the other side of the sheet material during the applying operation and being disposed in a substantially coaxial alignment with respect to the first tool member, said second tool member being engageable with the fastener member for moving the fastener member in an axial direction toward the cap member, wherein the fastener member receives the cap member fastening means in locking engagement therewith after penetration of the fastening means through the sheet material, and an annular flexible member being provided that is fixed to one of the tool members for contacting the sheet material upon the axial movement of the tool members during the applying operation, the annular flexible member contacting the sheet material circumferentially of the cap and fastener means and being deformable for urging the sheet material circumscribed thereby into a stretched position as said fastening means are penetrated through the sheet material, wherein wrinkling of the material after disengagement of the tool elements following the applying operation is prevented.

Accordingly, it is an object of the present invention to provide apparatus and a method by which a snap fastener element is applied to a sheet of material without producing wrinkles therein.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
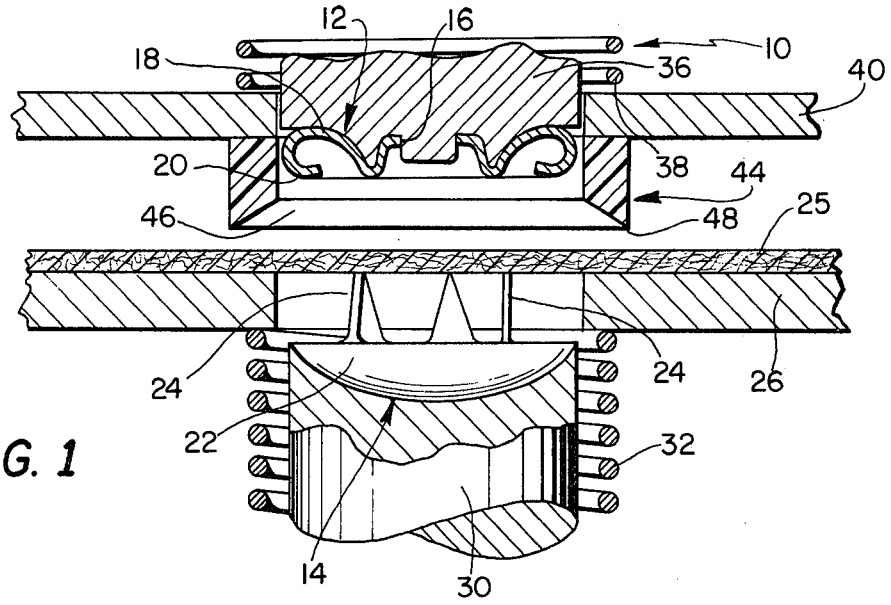
FIG. 1 is a vertical sectional view showing the apparatus for applying a snap fastener to a sheet of material just prior to the assembly operation.
Figure 2:
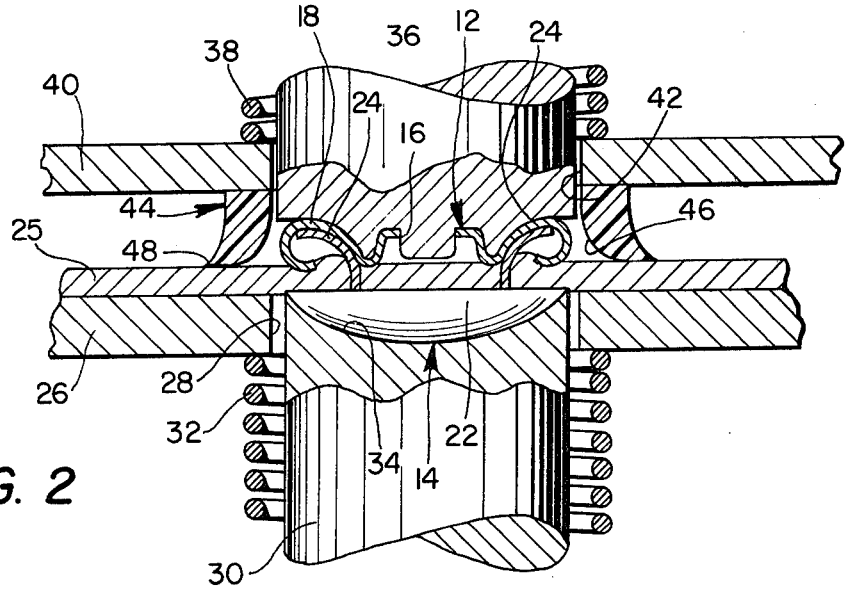
FIG. 2 is a sectional view similar to FIG. 1 and showing the apparatus during the application of the snap fastener to the sheet of material.

Referring now to the drawing and particularly to FIGS. 1 and 2, the apparatus for applying a snap fastener to a sheet of material as embodied in the present invention is illustrated and is generally indicated at 10. Although only the apparatus for assembling the snap fastener at the assembly station is illustrated in the drawing, the general details of construction of the complete apparatus are well known in the art, and one form of such apparatus is illustrated and described in the aforesaid Wolff U.S. Pat. No. 2,310,007.

The snap fastener that is assembled by the apparatus according to the subject invention is of the type that includes a socket member generally indicated at 12 and a cap member generally indicated at 14. The socket member 12 includes a socket portion 16 that in the use of the assembled fastener will receive a stud of a complimentary fastener. Also formed as part of the socket member 12 is a flared portion 18 that terminates in a reversely turned flange portion 20. The cap portion 14 which is conventional in construction includes a head portion 22 to the underside of which are joined fastening means, a preferred form of which are illustrated as prongs 24. However it is understood that other forms of fastening means may also be utilized without departing from the spirit of the invention. As will be described, in the application of the snap fastener to a sheet material indicated at 25, the cap member 14 and the socket member 12 are moved into engagement with each other, the prongs 24 penetrating the sheet material 25 and then engaging the flared portion 18 of the socket member 12. Thereafter, the prongs 24 are turned outwardly by the flared portion 18 into positive engaging relation therewith to complete the application of the snap fastener members to the sheet material 25.

As the prongs 24 of the cap member 14 pass through the sheet material 25, the sheet material normally would tend to stretch and thereby create wrinkles in the area of the snap fastener as applied thereto. As described, the purpose of the subject invention is to avoid the puckering or wrinkling of the material as the snap fastener members 12 and 14 are applied to the sheet material 25. As also described in U.S. Pat. No. 2,310,007, puckering or wrinkling of the sheet material during the application of the snap fastener members may be avoided by confining the stretching of the material during the setting of the snap fastener members in substantially the area to be covered by the members. Thus, if the confined area is properly prestretched, then the puckering and wrinkling of the sheet material that tends to occur after the application of the snap fastener members thereto will be avoided. Although U.S. Pat. No. 2,310,007 does describe and disclose apparatus that was intended to prevent the puckering and wrinkling of the material during the setting or applying of the snap fastener members thereto, it has been found that such apparatus did not satisfactorily perform the function as illustrated and described therein; and as will be described hereinafter, the present invention as represented by the apparatus 10 avoids the problems experienced with such prior known apparatus.

Referring again to the drawing, the sheet material 25 is shown as placed on a table or support 26 for receiving the snap fastener members in engagement thereon. Formed in the support is an opening 28 and extending upwardly through the opening 28 is a lower anvil 30 that is mounted in an anvil body (not shown) and that is operatively moved in a vertical direction by a hydraulic unit, one example of which is illustrated in U.S. Pat. No. 2,310,007. Encircling the anvil 30 is a coil spring 32 that is engaged with the underside of the support 26, the spring 32 cooperating with the hydraulic unit of the lower anvil body to effectively produce the required movement of the anvil 30 as also illustrated in U.S. Pat. No. 2,310,007. As shown, the uppermost end of the anvil 30 is formed with a concave configuration for receiving the head portion 22 of a cap member 14 in seated relation as the cap member is fed thereto for an assembly operation. Although not shown, a convenient cap feeding device is provided for sequentially feeding the cap members 14 to the anvil 30 at the assembly station, one example of such a cap feeding device also being illustrated and described in U.S. Pat. No. 2,310,007.

Disposed in coaxial alignment with the lower anvil 30 is an upper anvil 36 that is formed as part of an upper anvil assembly, the upper anvil assembly being hydraulically actuated by suitable operating means for movement of the anvil 36 in a downward direction during the assembly of the cap member 14 to the socket member 12. As shown, the lowermost end of the upper anvil 36 is provided with a specific configuration for accommodating a socket member 12 in engagement therewith, and the upper anvil 36 also cooperates with suitable feeding means that sequentially directs the socket members 12 to the anvil member 36 at the assembly station. Encircling the upper anvil 36 is a coil spring 38; and as will be described hereinafter, the coil spring 38 is initially compressed upon operation of the upper anvil assembly and cooperates therewith to properly locate the upper anvil 36 at the assembly station.

Figure 3:
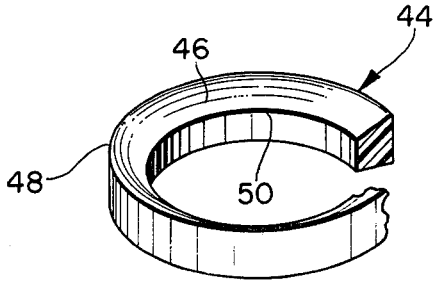
FIG. 3 is a perspective view with parts shown in section of the annular flexible member that provides for stretching of the sheet material during the application of a snap fastener thereto.

Formed as part of the upper anvil assembly is an upper plate 40 in which an opening 42 is formed for receiving the upper anvil 36 therethrough. The upper plate 40 is movable in response to the operation of the upper anvil assembly, and as will be described in movable is response to the compression of the coil spring 38 following a preliminary movement of the upper anvil 36 to the assembly position. Secured to the underside of the upper plate 40 is an annular flexible ring generally indicated at 44 and which is more clearly shown in FIG. 3. The annular flexible ring 44 which is formed of a plastic material such as urethane has an inside diameter corresponding generally to the diameter of the opening 42 as formed in the plate 40, and is formed with a relatively flat surface on the upper end thereof that engages the underside of the plate 40. The lowermost end of the annular flexible ring 44 is tapered or inclined to form a countersunk area as indicated at 46. Thus, the downwardly facing inclined end 46 of the ring 44 is defined by an outer edge 48 and an inner edge 50. As will be described, the outer edge 48 and the end 46 of the ring 44 are engageable with the upper surface of the sheet material 25 during the assembly of the snap fastener member thereto and produce a tensioning effect on the area of the sheet material 25 that is circumscribed by the ring 44 during the assembly operation.

Prior to the assembly of the snap fastener members 12 and 14 on the sheet material 25, it is understood that the socket member 12 has been fed by the appropriate feed mechanism to the assembly station as illustrated in FIG. 1, and similarly the cap member 14 has also been fed by its appropriate feed mechanism to the assembly station. In this location, the prongs 24 of the cap member 14 are disposed in an upstanding position below the sheet material 25 with the head portion 22 of the cap member 14 resting within the upper concave portion 34 of the anvil 30. With the socket member 16 engaged by the upper anvil member 36 as shown in FIG. 1, the anvils 30 and 36 are moved in an axial direction toward the sheet material 25. Just prior to the prongs 24 penetrating through the sheet material 25, the anvil 36 moves downwardly to locate the socket member 12 in position for receiving the prongs 24 in engagement with the flared portion 18 thereof. Following the initial movement of the anvil 36 downwardly through the opening 42 in the plate 40 to position the socket member 12 for the assembly operation, the coil spring 38 is compressed and the upper plate 40 is then moved with the anvil 36 toward the sheet material 25, thereby moving the lower inclined end 46 of the annular flexible ring 44 into engagement with the upper surface of the sheet material as shown in FIG. 2. As the prongs 24 of the cap member 14 begin to penetrate the sheet material 25, the outermost edge 48 of the flexible ring 44 in contact therewith is forced outwardly in the direction of the arrows, as shown in FIG. 2; and thus stretches the area of the sheet of material that is circumscribed by the ring 44. Since the area as circumscribed by the annular flexible ring 44 is stretched, the prongs 24 penetrate easily therethrough and are moved into locking engagement with the flared portion 18 of the socket member 12 upon continued upward movement of the anvil 30. After the assembly of the socket member 12 and the head member 14, the anvils 30 and 36 are retracted, thereby releasing the flexible ring 44 from engagement with the sheet material 25. Since the stretching of the material has been essentially radially outwardly and is confined within the area as encompassed by the annular flexible ring 44, the surrounding material is maintained free from tension and puckers and wrinkles therein are avoided. Further, the movement of the prongs through the material does not stretch the material in a contracting manner and the material thus does not accumulate to produce puckering.

It is evident from the description of the apparatus and method described above that the annular flexible ring 44 provides a simple yet effective manner of radially stretching the sheet of material 25 as confined within the ring 44 so that the prongs of the cap member 14 are easily penetrated through the sheet of material without resulting in puckers or wrinkles in the surrounding areas thereof. Although a particular form of operating mechanism for the assembly equipment is not illustrated in the drawing, it is understood that any suitable and conventional form of mechanism may be used without departing from the spirit of the invention.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for applying a snap fastener to an imperforate sheet of material, wherein said snap fastener includes a cap member having fastening means extending outwardly thereof and a fastener member that is shaped to receive said fastening means for interlocking said cap and fastener members on opposite sides of said sheet material, comprising a first tool member that is locatable on one side of said sheet material during the applying operation and that is engageable with said cap member for moving said cap member in an axial direction to cause said fastening means to penetrate said sheet material, a second tool member locatable on the other side of said sheet of material during the applying operation and being disposed in substantially coaxial alignment with respect to said first tool member, said second tool member being engageable with said fastener member for moving said fastener member in an axial direction toward said cap member during the applying operation, wherein said fastener member receives said fastening means in locking engagement therewith after penetration of said fastening means through said sheet material means extending outwardly from one of said tool members to support said sheet material and thereby promote the stretching thereof during said applying operation, and an annular flexible member fixed to the other of said tool members for contacting said sheet material upon the axial movement of said tool members during the applying operation, said annular flexible member contacting said sheet material circumferentially of said cap and fastener members and being deformable for radially urging the sheet material circumscribed thereby into a stretched position as said fastening means penetrate through said sheet material during engagement of said cap member with said fastener member, wherein wrinkling of said material after disengagement of said tool members following the applying operation is prevented.

2. Apparatus as claimed in claim 1, said annular flexible member having generally ring-like configuration, the outer annular surface thereof that contacts said sheet material being inclined inwardly to form a countersunk portion having an annular outer edge that is urged radially outwardly as said flexible member is moved into contact with said sheet material, thereby stretching said sheet material circumscribed by said flexible member.

3. Apparatus as claimed in claim 2, said annular flexible member being formed of a urethane plastic material.

4. A method of applying a snap fastener to an imperforate sheet of material, wherein said snap fastener includes a cap member having fastening means joined thereto and a fastener member that is shaped to receive said fastening means for interlocking said cap and fastener members on opposite sides of said sheet material, comprising the steps of moving said cap and fastener members in coaxial relation on opposite sides of said sheet material and into contact therewith for penetration of said fastening means therethrough and simultaneously providing support to one surface of said sheet material while contacting the other surface thereof in such a manner as to radially stretch the material contacted and penetrated by said fastening means so that upon release of said material after the applying operation wrinkling of the material around the assembled snap fastener is avoided.

5. A method as claimed in claim 4 comprising the further steps of locating a flexible annular member in surrounding relation relative to one of said members, and moving said flexible annular member into engagement with said sheet material during the applying operation so as to surround said cap and fastener members and thereby stretch the material circumscribed by said annular member as said prongs penetrate said material.

6. A method as claimed in claim 5, comprising the further steps of forming the end of said annular flexible member that engages said sheet material with an inwardly extending taper that defines an annular outer edge, and urging said outer edge in an outer radial direction as said flexible member engages said sheet material to produce the stretching thereof.

7. Apparatus for applying a snap fastener to an imperforate sheet of material, wherein said snap fastener includes a cap member having fastening means extending outwardly thereof and a fastener member that is shaped to receive said fastening means for interlocking said cap and fastener members on opposite sides of said sheet material, comprising a first tool member that is locatable on one side of said sheet material during the applying operation and that is engageable with said cap member for moving said cap member in an axial direction to cause said fastening means to penetrate said sheet material, a second tool member locatable on the other side of said sheet of material during the applying operation and being disposed in substantially coaxial alignment with respect to said first tool member, said second tool member being engageable with said fastener member for moving said fastener member in an axial direction toward said cap member during the applying operation, wherein said fastener member receives said fastening means in locking engagement therewith after penetration of said fastening means through said sheet material, an upper plate located adjacent to said first tool member and a lower plate located adjacent to said second tool member said lower plate receiving said sheet material thereon, and acting as a support therefor during the applying operation, an annular flexible member secured to the underside of said upper plate for contacting said sheet material upon axial movement of said tool members during the applying operation, said annular flexible member contacting said sheet material circumferentially of said cap and fastener members and being deformable for radially urging the sheet material circumscribed thereby into a stretched position as said fastening means penetrate through said sheet material during engagement of said cap member with said fastener member, wherein wrinkling of said material after disengagement of said tool members following the applying operation is prevented and means for moving said upper plate downwardly toward said sheet material during the applying operation so as to urge said annular flexible member into contact with said sheet material.

* * * * *